United States Patent [19]

Speitel et al.

[11] 4,266,682

[45] May 12, 1981

[54] STOPPING DEVICE FOR A THREADED NECK CONTAINER

[75] Inventors: Francois Speitel, Connerre; Robert Speitel, Parigne L'Eveque, both of France

[73] Assignee: Teleplastics Industries S.A., Parigne L'Eveque, France

[21] Appl. No.: 20,020

[22] Filed: Mar. 13, 1979

[30] Foreign Application Priority Data

Mar. 17, 1978 [FR] France ..... 78 07880
Jan. 23, 1979 [FR] France ..... 79 01600

[51] Int. Cl.[3] ..... B65D 41/04
[52] U.S. Cl. ..... 215/331; 215/334
[58] Field of Search ..... 220/325, 256, 288; 215/331, 330, 334, 329, 219, 218, 220

[56] References Cited

U.S. PATENT DOCUMENTS

| | | | |
|---|---|---|---|
| 2,847,139 | 8/1958 | Christiansson et al. | 215/334 X |
| 3,064,844 | 11/1962 | Hoffman | 215/31 |
| 3,315,830 | 4/1967 | Flynn | 215/334 |
| 3,372,825 | 3/1968 | Laviano | 215/220 X |
| 3,374,912 | 3/1968 | Velt | 215/220 |
| 3,581,926 | 6/1971 | Roder | 215/330 |
| 3,667,642 | 6/1972 | Blau et al. | 220/288 |
| 3,756,444 | 9/1973 | McIntosh | 215/220 |

FOREIGN PATENT DOCUMENTS

| | | | |
|---|---|---|---|
| 653884 | 5/1951 | United Kingdom | 215/329 |

*Primary Examiner*—Allan N. Shoap
*Attorney, Agent, or Firm*—Young & Thompson

[57] ABSTRACT

The present invention relates to a stopping element made of a cylindrical cap 11 threaded inside and intended for being screwed onto the corresponding threading of the neck of the flask, the cap being joined to an outer member 8. According to the invention, the threaded cap 11 and the member 8 are movable relative to each other axially and joinly in rotation. The invention provides the bringing into coincidence of the cross-sections of the flask and of the outer member.

8 Claims, 6 Drawing Figures

STOPPING DEVICE FOR A THREADED NECK CONTAINER

The present invention relates to stopping devices for flasks, bottles and other containers with a threaded neck, and more particularly a stopping element made of a cylindrical cap threaded inside for being screwed on the corresponding threaded flask neck, the cap being secured to and sometimes manufactured integral with an envelope or outer member for providing the stopping element with an aesthetic appearance.

When such stopping elements with a non-cylindrical outer member are used on non-cylindrical flasks intended for perfumes, toilet waters, beauty products or the like, the aesthetic appearance of the assembly formed of the stopping element and the flask is of primary importance and it is particularly necessary to provide a perfect coincidence of position of the outer member of the stopping element and the flask portion in the blocking position at the end of the path of travel of the threaded cap.

It has been attempted first to solve this problem by orientating correctly the outer member relative to the cap so that in the blocking position at the end of the path of travel of the inner threading of the cap, the portions be in alignment. In order to provide more easily such an alignment when manufacturing the stopping element, it has been proposed to mount the outer member of the stopping element on the inner threaded cylindrical cap by screwing first of all, on the neck of the flask, the cap the outer surface of which is provided with longitudinal grooves, and by forcibly fitting onto the cap, by giving it the desired orientation, the outer member which comprises to this end an inner nesting portion the shape of which is complementary to the outer surface of the cap. However after repeated tightening and untightening actions of the stopping element, the blocking position at the end of the path of travel of the inner cap is quite often slightly shifted due to the wear of the threads or compression of the sealing elements, and the proper orientation of the stopping element is no longer obtained relative to the flask body, or the position in coincidence does not ensure a sufficient tightening of the sealing joints.

There has also been proposed a device in which one uses a snap arrangement for nesting the outer member on the flask body in the vicinity of the blocking position at the end of the travel of the cap. In this case, the outer member and the threaded cap are rigid one with the other, the peripheral edge of the outer member forming a protruding lip and the upper surface of the flask surrounding the neck being formed at its periphery with a bearing surface in the shape of a groove in which the lip of the peripheral edge of the outer member comes to nest so as to align the parts. However, in order that such a nesting between surfaces which are not surfaces of revolution is possible, the relative longitudinal displacement providing the nesting of the lip in the groove has to be provided during a very limited angular rotation corresponding to a fraction of about one eighth of a turn of the stopping element, the threading of which should therefore have a very steep pitch. Moreover, the flask wall between the nesting groove and the threaded neck has to be resiliently deformable since the upper surface of the wall is already in contact with the outer member lip edge when the latter should still, under the screwing effect of the cap, come down along the height of the nesting. The result is that the flask has to be made from plastics, which prohibits flasks made of glass or any other rigid material such as those usually employed in luxury perfumery. Moreover, it is certain that the contact surfaces between the outer member and the flask body have to be planar, which limits the aesthetic possibilities. Furthermore, with such a stopping device, the screwing operation of the cap is limited not by the abutment at the end of the travel of the cap, but through the nesting movement between the outer member and the flask body. Due to the steepness of the pitch, a small rotation angle corresponds to a relatively great longitudinal displacement of the cap, and there is a risk of a faulty stopping due to an insufficient tightening of the joint seal. Finally, the resiliency and deformability of the elements nesting into each other as well as the high torque resulting from the steep pitch of the joint seal which transforms the resilient tightening of the joints into an unscrewing torque result in the cross-sections of the outer member and the flask never being in perfect coincidence.

The present invention aims at overcoming the hereabove disadvantages by providing a stopping element the outer member of which, in its stopping position, is always correctly orientated relative to the flask body.

The present invention reaches this result by providing relative axial displacement, and rotation, between the threaded cap and the outer member. By a partial loosening of the connection in axial displacement and in rotation, is meant a possibility of varying the relative longitudinal position of the two members, and a possibility of variation of the relative angular position between the two members with nevertheless between these members a resilient bias, or a friction force associated with a mechanical snap-in engagement having a tendency of maintaining both members in a definite relative spatial position.

According to a first embodiment, the inner member including a cylindrical cap is nested into an axial sleeve of the outer member with, between the two parts, a snap-in engagement permitting between these parts a relative rotation over a substantial angle the nesting permitting a relative axial displacement equal to the height of nesting between the outer member and the flask.

According to a second embodiment, the inner member including a cylindrical cap is nested inside an axial sleeve of the outer member with, between the two parts, a driving connection permitting an extra rotation of the outer member relative to the cap over a reduced angle corresponding to the clearance in the tightening position of the cap, the driving connection permitting a relative axial displacement equal to the height of the nesting between the outer member and the flask. By reduced angle corresponding to the clearance in the tightening position of the cap is meant the rotation angle necessary for bringing the outer member from the tightening position of the cap to the nesting position, that is, in coincidence with of the cross-section of the flask. Since the blocking position of the cap may slightly vary over a reduced angle as hereabove explained, this position is fixed by the construction so as to be in front of one of the snap-in positions with an angular gap greater than to said reduced angle and the driving connection permits an extra rotation of the outer member so that the cap being tightened, it may be possible to turn the outer member so as to bring it to the nesting position. It is obvious that the shifting angle in the forward direction could be smaller than the value fixed hereabove, zero or even negative without departing from the scope of the invention, but in such a case the cap would not be blocked and the stopping would be faulty.

In one or the other of these embodiments, a resilient means may be interposed between the cap and the embellisher for biasing the outer member longitudinally towards the nesting position relative to the cap. Such resilient means may be a compression spring, a blade spring, a foam material or a resilient washer.

According to a third embodiment, the cylindrical cap forming the threaded portion which fits on the neck is secured to an element forming a lining which is nested inside the outer member and secured in rotation by a peripheral skirt of the outer member, at least the bottom portion of the element forming the lining being made of a flexible material.

In this embodiment, the resilient means interposed between the cap and the outer member for biasing the outer member longitudinally towards the nesting position relative to the cap is provided by a flexible bottom surface of the element forming the lining, the resiliency of this bottom surface as well as the depression created between this bottom surface and the bottom of the outer member creating the resilient biasing force.

According to a further characteristic of this embodiment, the threaded cap is molded in a single piece with the element forming the lining. In this case and to avoid a jamming of the cap threading made of a flexible material, a rigid reinforcement ring is engaged around the cap.

In this embodiment also, and for providing the transmission of the screwing torque of the outer member to the threaded cap by neutralizing the resilient deformation possibility of the peripheral skirt made of a flexible material, the peripheral skirt and the peripheral portion of the bottom surface of the lining element may be glued onto the inner surface of the skirt of the outer member, or a rigid and/or extensible ring can apply the peripheral skirt against the inner surface of the skirt of the outer member.

Resilient means biasing the outer member in rotation towards the longidutinal nesting position relative to the cap may also be interposed between the cap and the outer member. The resilient means may be combined with the resilient means biasing the outer member longitudinally.

For ensuring a perfect orientation of the outer member relative to the flask in the nesting position, in spite of the manufacturing tolerances of glassware factories, cooperating radial abutment surfaces may be provided on the flask and on the outer member. The orientation of the outer member of the stopping element at the moment of its longitudinal nesting may be controlled by the longitudinal nesting of at least one notch and one tooth which are part one of the embellisher and the other of the upper surface of the flask.

According to the invention and due to the fact that the threaded cap and the embellisher are partly disconnected in axial displacement, the bringing into coincidence of the peripheral surfaces of the stopping means and of the flask is no more necessarily provided according to a plane radial surface extending into a separation line perpendicular to the axis, but can be provided according to broken, indented, sinusoidal and other lines. The invention provides therefore, on the one hand, a tight stopping while bringing into perfect coincidence parts of the outer member and of the flask, and on the other hand broader possibilities as regards aesthetics in the case of a flask with a stopping element of this type.

Of course, the cap may be provided with any type of known sealing member cooperating with the flask neck without departing from the scope of the present invention. In the case where the partial disconnection relates exclusively to the axial displacement, a sealing of a progressive type is preferable for instance to a sealing by a frustoconical or a cylindrical skirt made of a flexible material nesting in the flask neck, and the peripheral surface of said skirt may be formed with protruding swellings or a sealing arrangement provided by a deformable protrusion formed in the bottom of the cap concentrically and at a small distance from the threaded sleeve of the cap.

Further characteristics and advantages of the present invention will become more apparent from the following description of various embodiments of a stopping element according to the invention, reference being made to the accompanying drawings wherein.

Figure 1:
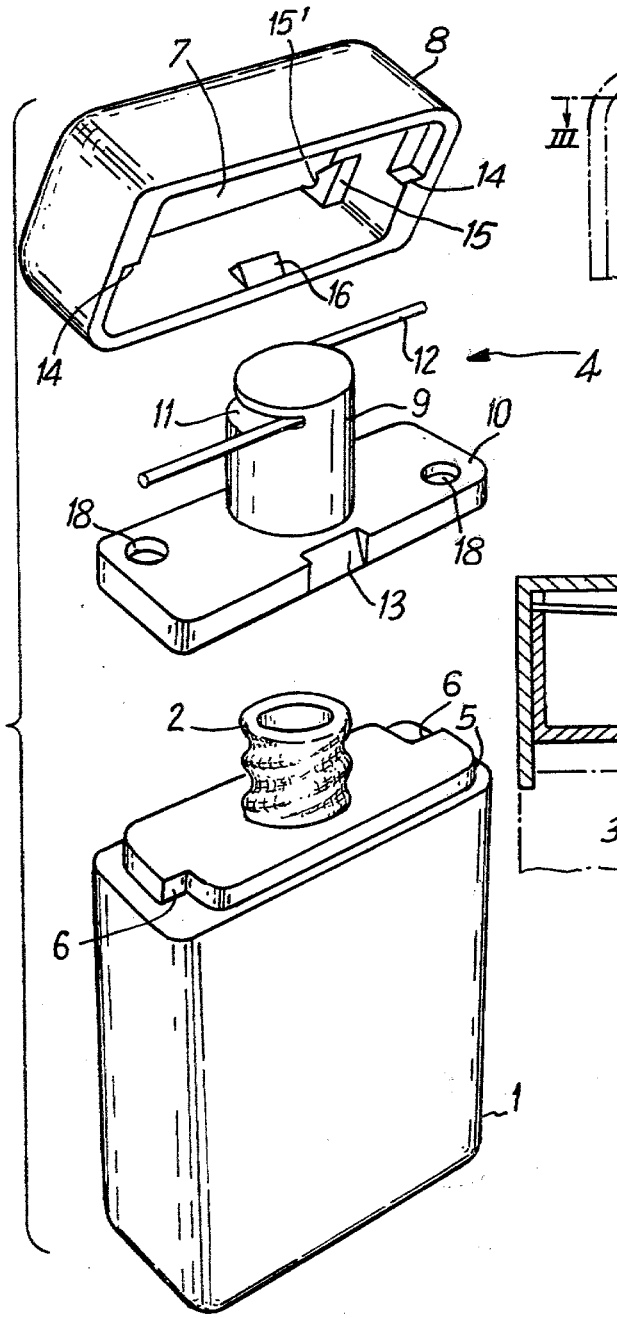
FIG. 1 is an exploded perspective view of a flask and of a stopping element according to the present invention.

Referring first to FIG. 1, the invention applies to a flask 1 or similar container of general rectangular cross-section, comprising a threaded neck 2 on which can be screwed the stopping element 4, the neck 2 comprising an integral shoulder 5 provided with two diametrically opposite surfaces 6 forming positioning abutments.

The stopping element 4 comprises, according to the present invention, an outer member which, in the embodiment shown, forms the enclosure of the stopping element. This outer member of rectangular cross-section corresponding to that of the flask comprises a flat top wall 7 surrounded by a peripheral skirt 8 and an inner member formed mainly of a female cylindrical sleeve 9 of a height less than the height of the skirt forming the stopping cap as such, the base portion of which is surrounded by a flange 10 the surface of which corresponds to the inner cross-section of skirt 8. This cap is provided in known manner with an inner threading for being screwed onto the threading of neck 2. On the other hand, the upper portion of sleeve 9 comprises a notch 11 in which is engaged a spring 12 made of a piano wire the two branches of which extend on either side of the sleeve. The flange 10 is moreover formed with notches 13 allowing the insertion of the inner member in the outer member, the bottom portion of the skirt 8 being formed to this effect with two diametrically opposite bosses 16 protruding towards the inside and for engagement into the notches 13 in a manner as to limit the vertical displacement of the inner member inside the outer member. Two tenons 15 forming wedge ramps are positioned inside of the skirt 8, in diametrically opposite positions near the top wall 7 and they comprise in the vicinity of their upper portion housings 15' for receiving the ends of the spring 12, as will be explained hereafter. Finally, the free edge of the skirt 8 has housings 14 so as to engage exactly on the neck 3 with the vertical faces of the housings 14 in abutment against the surfaces 6 of the neck.

The stopping element 4 according to the invention is assembled by nesting with the assistance of the notches 13 and the bosses 16, the inner member in the outer member, the ends of spring 12 being engaged above the tenons 15 with the assistance of a tool introduced in the holes 18 of flange 10 and coming inside housings 15', the spring being pre-tightened so as to bias the inner member into the outer member. Due to the shape of the flange 10 and of the skirt 8, the inner member cannot turn inside the outer member, but is only capable of moving vertically, such displacement being limited by notches and bosses 13, 16.

In use, the stopping element is screwed onto the neck 2, the torque being transmitted by the nesting configuration of the flange 10 and the skirt 8. The free edge of the skirt 8 comes in abutment against the upper surface of the shoulder 5 before the threaded sleeve 9 is entirely screwed. However, since the outer member can move in translation relative to the inner member by further stressing spring 12, it is possible to effect an extra rotation of the stopping element corresponding to about half a turn for completing the screwing. At this moment, the cross-section of the outer member comes into coincidence with the cross-section of the flask shoulder, so that under the action of spring 12, the free edge of the skirt 8 comes in snap-into resilient engagement with the shoulder 5 of the flask neck, the notches 6 and the protrusions 14 preventing by their mutual abutment any orientation shift between the cross-section of the outer member and the corresponding cross-section of the flask. On the other hand, for avoiding a forcible disengagement of the stopping element, the spring 12 is given a sufficient force. When unstopping, the operation is the reverse, and this operation may be made easier and the positioning improved by rounding the edge of the shoulder 5 which extends to the inner edge of surface 6 for forming an inclined plane which transforms the resilient axial bias imposed on the skirt 8 by the spring 12 when screwing into a torque biasing the faces 14 of the skirt 8 against the abutment faces 6 of the neck and transforming reversely the unscrewing torque imposed on the outer member into an axial force which lifts it while stressing the spring 12.

Figure 2:
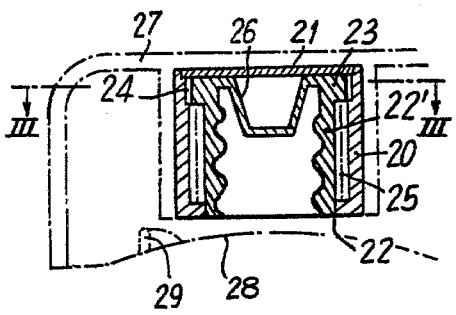
FIG. 2 is an axial sectional view of a second embodiment of a stopping element according to the present invention adapted for receiving an outer member of any cross-section.
Figure 3:
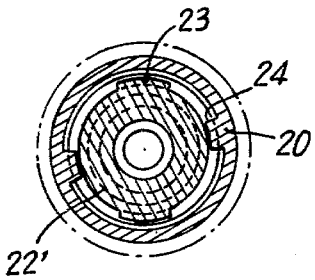
FIG. 3 is a sectional view along line III—III of FIG. 2.

FIGS. 2 and 3 show another embodiment of the stopping element according to the present invention, which remedies some drawbacks of the embodiment of FIG. 1 according to which the angle for bringing into coincidence the cross section of the outer member has to correspond exactly to the stopping angle of the cap which provides sufficient sealing. In fact, the cap and the outer member do not have any freedom in relative rotation due to the nesting of the sections. More precisely, this figure comprises a standard member adapted to be secured to the outer members of various models by snap-in engagement, soldering or any other method. This member is made of a cylindrical sleeve 20 the upper end of which is closed by a cover 21 for allowing its mounting and the edge portion of which is formed with an inner flange 22. In this sleeve 20 is inserted a threaded cap 22' of known type which may slide inside the opening of the flange. The upper end of the cap 22' is formed with at least two radial protrusions 23 for cooperation with inner radial protrusions 24 provided on the upper portion of the inner wall of sleeve 20, such a disposition being intended to drive in rotation the cap 22' through the driving of the sleeve 20 for the screwing and unscrewing. On the other hand, between the flange 22 of the sleeve 20 and the cap 22' is inserted a spiral spring 25 acting as a compression spring for biasing the cap 22' against the cover, and on the other hand as a torsion spring for biasing the sleeve 20 relative to cap 22' in a reverse direction to that ensuring screwing, for the reasons explained herebelow. Moreover, for obtaining a better sealing, the inner cap 22 is formed in a known manner with a frustoconical protrusion 26 which fits into the flask neck.

On the sleeve is nested an outer member 27 shown in phantom, which may be of any cross-section including a circular cross-section, the section for which the invention is essential when, as is shown, the edge 28 which is adapted to come to bear against the upper edge of the flask body and the edge thereof are not plain but have an indented, undulated or other profile, which was not possible heretofore with stopping devices provided with an outer member.

For using the stopping device of FIGS. 2 and 3 provided with its outer member, the stopping device is presented as usual, facing the neck of the flask on which it is screwed. When the screwing torque becomes high, the spring 25 tightens in torsion and the radial protrusions 24 of the sleeve come into abutment against the radial protrusions 23 of the cap for providing the drive in rotation of the cap until complete tightening. As soon as a point of the edge on the skirt of outer member 26 comes to bear during the progression of the operation against a point on shoulder 5 or of the upper edge of the flask, the spring 25 is compressed thereby allowing a displacement of the cap resulting from the screwing relative to the sleeve 20 which is stopped due to this abutment. During blocking of the cap, the outer member 27 should, due to the mounting itself, have slightly moved beyond the coincidence position of the cross-section of the outer member and the flask. When it is freed, the spring 25 acting as a torsion spring tends to bring back the outer member towards this coincidence position, while it acts as a compression spring for providing the nesting of the parts. If the precision of the nesting is not sufficient for ensuring a correct orientation, there may be provided on the outer member a radial abutment surface 29 which comes into abutment during the rotation in reverse direction against a corresponding surface provided on the flange. This abutment forms also a locking against any accidental unstopping, since, in order to apply to the cap an unscrewing torque, the outer member has first to be pulled in order to remove the surface 29 from the corresponding abutment surface provided on the flask, or a higher torque has to be exerted if said surfaces are helicoidal ramps with a steep pitch.

Figure 4:
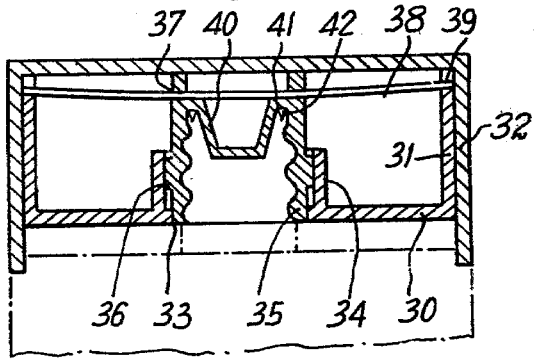
FIG. 4 is an axial sectional view of a third embodiment of a stopping element according to the present invention.

A third embodiment of the stopping element according to the invention will now be described with reference to FIG. 4. The outer members of the stopping element is made of a base portion 30 surrounded with a vertical wall 31 on which the outer member 32 of the stopping element comes into a snap-in engagement, or is fixed by soldering or any similar method. The base plate 30 is provided in its central portion with a circular window 33 through which may slide the stopping cap. Said window 33 is surrounded by a sleeve 34 protruding towards the inside and intended as a guiding element for the stopping cap. The stopping cap is made as is usual with a cylindrical sleeve 35 threaded inside and with an outer diameter which is substantially equal to the diameter of window 33. The sleeve 35 of the cap is surrounded at a distance from its ends by a flange 36 coming to bear against the inner wall of the sleeve 34 and adapted for limiting the path of travel of the cap relative to the outer member. On the other hand, the cap 35 is formed on its upper portion with two diametrically opposite holes 37 through which extends a blade spring 38 the two ends of which are fixed in notches 39 provided on the upper portion of the wall 31. Moreover, the sleeve 35 of the cap is closed in a known manner by a frustoconical dish 40 forming a stopper provided for fitting into the flask neck. In order to provide a better sealing of the stopping element, the groove 41 which forms a connection between the sleeve 35 and the dish 40 is formed with a V-shaped lip 42 which comes to bear against the upper portion of the neck.

This embodiment operates in a similar manner as the first embodiment described with reference to FIG. 1, but its construction is simpler. However, the screwing torque is transmitted to the cap only by the blade spring 38 and it may be advantageous to provide an extra width for the notches 39 in order to permit a relative rotation of the outer member relative to the cap and to provide a rigid connection in rotation by replacing the flange 36 by teeth engaged in extra large notches formed in the inner surface of the sleeve 34. With this alternative embodiment, the bringing into coincidence of the cross-sections of the outer member and the flange flask is done manually unless it is provided by a snap-in engagement which is effected automatically under the action of the blade spring 38 when the sealing of the cap which, due to the lip 42, is reached before the mechanical blocking of the cap, is ensured.

Figure 5:
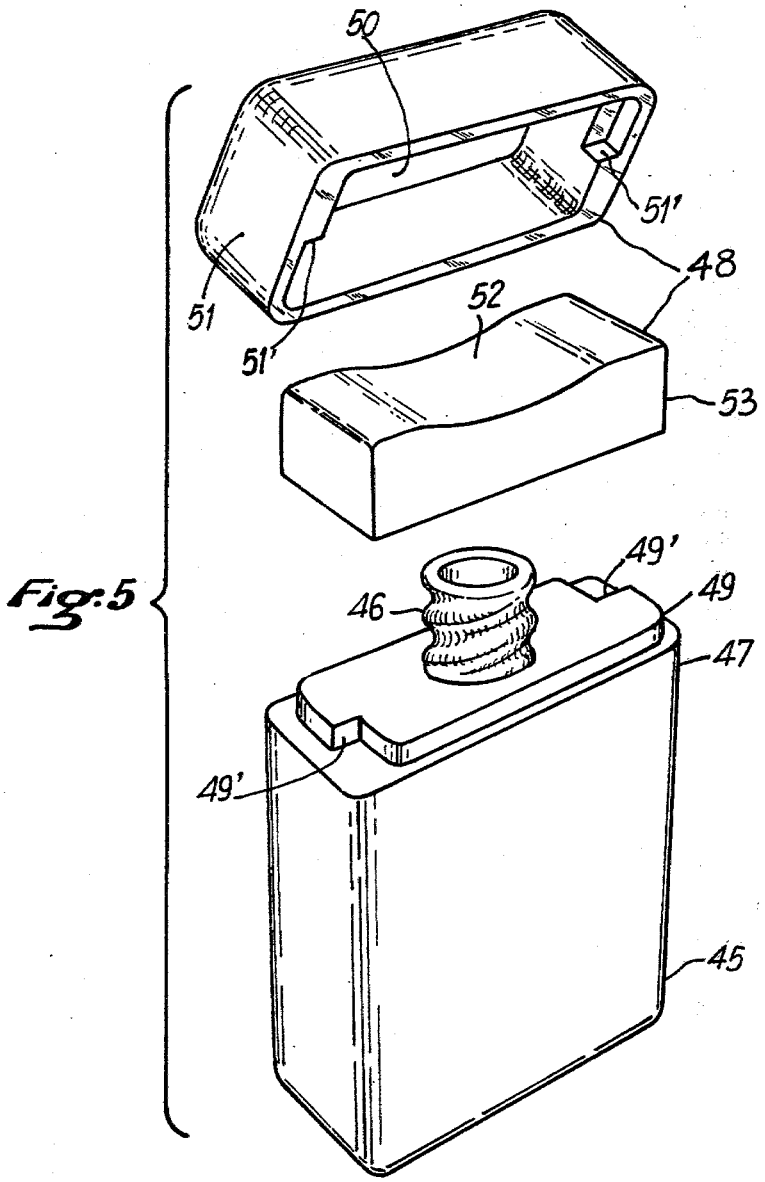
FIG. 5 is an exploded perspective view of a flask and of a stopping element according to a fourth embodiment of the invention.
Figure 6:
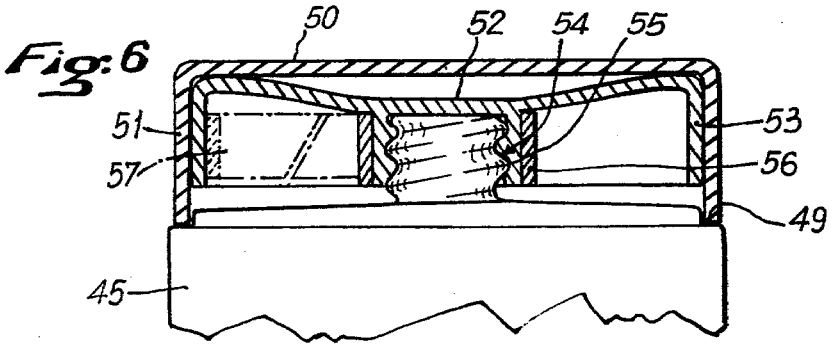
FIG. 6 is an axial sectional view of the stopping element according to the embodiment of FIG. 5.

A fourth embodiment of the stopping element of the present invention will now be described with reference to FIGS. 5 and 6. The stopping element is applied to a flask 45 or similar container, of generally rectangular cross-section, but it is understood that the stopping element can also be applied to flasks having any other type of cross-section, and that it is particularly adapted to complex cross-sections. The flask 45 has therefore a threaded neck 46 on which may be screwed the stopping element 48, and the neck portion 47 of which is formed with a shoulder 49 integral with it and having two diametrically opposite surfaces 49' forming positioning abutments.

The stopping element 48 comprises an outer member which forms the decorative visible portion of the stopping element and an inner member fixedly secured to the threaded cylindrical cap fitting onto the neck 46. This outer member of rectangular cross-section corresponding to that of flask 45 is made of a rigid material and comprises a flat bottom surface 50 surrounded by a peripheral skirt 51. On the other hand, the free edge of the skirt is formed inside with housing 51' so as to come into exact engagement on the neck 47 with the vertical faces of housings 51' in abutment on the surfaces 49' of the neck. The inner member of the stopping elements is made of a lining element of cross-section corresponding to the inner cross-section of the outer member. The lining element is constituted by a bottom surface 52 made of a flexible material such as a flexible plastics material which is surrounded by a skirt 53 of lesser height than the height of the skirt 51 of the outer member. The cylindrical cap 54 is, in the embodiment shown, molded integrally with the element forming the lining and is therefore made of the same flexible plastics material as the latter. The cylindrical cap 54 is provided on its inner surface with a threading 55 corresponding to the threading of the neck of flask 45. On the other hand, a reinforcement cylindrical ring made of a rigid material 56 is engaged around cap 54 for avoiding any jamming of the threading of the cap. The skirt 53 of the element forming the lining is joined to the skirt 51 of the outer member through a ring 57. However, the connection could be obtained by any the like means such as glue or other.

When using the stopping element, the latter is screwed onto the neck, the torque being transmitted due to the connection of the skirt 53 of the lining element with the skirt 51 of the outer member. The free edge of the skirt 51 comes in abutment against the upper surface 49 of the neck before the threaded cap is entirely screwed, and due to the resilient deformation of the bottom surface 52 of the lining element and of the side surfaces of the cylindrical cap 54, as well as to the depression created between said bottom surface and the bottom surface 50 of the outer member, a resilient biasing force is created which permits an extra screwing so that the cross-section of the outer member comes into coincidence with the cross-section of the flask neck. At this moment, free edge of the skirt 51 of the outer member blocks itself resiliently on the shoulder 49 of the neck of flask 45, notches 49' and protrusions 51' preventing by their engagement in abutment any orientation shift between the cross-section of the outer member and the corresponding cross-section of the flask.

The hereabove described embodiments may receive many modifications without departing from the scope of the appended claims.

What is claimed is:

1. A stopping element of the capsule type consisting of an element including a cylindrical cap threaded inside for being screwed onto the corresponding threading of a flask neck and of an outer embellisher nesting on the surface of the flask surrounding the neck, the element including the threaded cap being slidably engaged in axial displacement in a corresponding seating of the embellisher with means resiliently biasing said element within the seating of the embellisher and means liable to transmit a torque between said embellisher and said element.

2. A stopping element for a threaded neck container, comprising an inner member including a cylindrical cap with an internal thread for engagement with the corresponding thread of the container neck, an outer member comprising a top wall and a peripheral skirt that depends from said top wall and that has a lower edge and that surrounds the inner member, the inner member being mounted for relative vertical displacement in the outer member, spring means spaced from said internal thread resiliently biasing the inner member upwardly relative to said outer member when said stopping element is attached to or separate from the container and means to transmit torque between the outer member and the inner member.

3. A stopping element as claimed in claim 2, and an axial sleeve on the outer member, said skirt surrounding said axial sleeve, the inner member being nested in the axial sleeve with an engagement allowing relative rotation over a substantial angle, the outer member being adapted to receive the top of the container in nested relationship, the engagement between the axial sleeve and the inner member allowing a relative axial displacement equal to the height of the nesting between the outer member and the container.

4. A stopping element as claimed in claim 2, the outer member having a further bottom wall spaced from the top wall, said lower wall terminating inwardly in a flange that surrounds the inner member.

5. A stopping element according to claim 2, wherein the upper surface of the container has radial abutment surfaces cooperating with radial abutment surfaces on the outer member.

6. A stopping element as claimed in claim 2, said spring means and the torque transmitting means comprising an element forming a lining rigid with the cap, said element being nested in and connected to the outer member by a further peripheral skirt, a portion of the lining between said further peripheral skirt and the cap being resilient and comprising said resilient biasing means.

7. A stopping element according to claim 6, and a rigid reinforcement ring engaged within said further peripheral skirt to apply said further peripheral skirt against the inner surface of the first-mentioned peripheral skirt.

8. A stopping element according to claim 7, wherein said ring is engaged also around said cap.

* * * * *